US008603709B2

(12) United States Patent
Wu

(10) Patent No.: US 8,603,709 B2
(45) Date of Patent: Dec. 10, 2013

(54) POLYURETHANE ANTICURL BACKSIDE COATING (ACBC) PHOTOCONDUCTORS

(75) Inventor: Jin Wu, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 702 days.

(21) Appl. No.: 12/823,455

(22) Filed: Jun. 25, 2010

(65) Prior Publication Data

US 2011/0318679 A1 Dec. 29, 2011

(51) Int. Cl.
*G03G 5/00* (2006.01)

(52) U.S. Cl.
USPC ..... 430/69

(58) Field of Classification Search
USPC ..... 430/69
See application file for complete search history.

(56) References Cited

U.S. PATENT DOCUMENTS 4,654,284 A 3/1987 Yu et al.
5,021,309 A 6/1991 Yu
5,069,993 A 12/1991 Robinette et al.
5,096,795 A 3/1992 Yu
5,919,590 A 7/1999 Yu et al.
5,935,748 A 8/1999 Yu et al.
6,303,254 B1 10/2001 Yu et al.
6,528,226 B1 3/2003 Yu et al.
6,939,652 B2 9/2005 Yu
7,662,525 B2 2/2010 Wu et al.
2008/0107985 A1 5/2008 Yanus et al.
2008/0305415 A1* 12/2008 Wu et al. ..... 430/58.1
2009/0208858 A1 8/2009 Wu et al.
2009/0208859 A1 8/2009 Wu et al.

* cited by examiner

*Primary Examiner* — Mark A Chapman
(74) *Attorney, Agent, or Firm* — Eugene O. Palazzo

(57) ABSTRACT

A photoconductor that includes a backing layer, a supporting substrate thereover, a photogenerating layer, and at least one charge transport layer of at least one charge transport component, and wherein the backing layer is in contact with the supporting substrate on the reverse side thereof, and the outermost layer of the backing layer is comprised of a polyurethane comprised of a dendritic polyester polyol and a polyisocyanate.

30 Claims, No Drawings

POLYURETHANE ANTICURL BACKSIDE COATING (ACBC) PHOTOCONDUCTORS

CROSS REFERENCE TO RELATED APPLICATIONS

There is disclosed in copending U.S. application Ser. No. 11/729,622, Publication No. 20080241720, now U.S. Pat. No. 7,662,525, filed Mar. 29, 2007, entitled Anticurl Backside Coating (ACBC) Photoconductors, a photoconductor comprising a first layer, a supporting substrate thereover, a photogenerating layer, and at least one charge transport layer comprised of at least one charge transport component, and wherein the first layer is in contact with the supporting substrate on the reverse side thereof, and which first layer is comprised of a polymer and needle shaped particles with an aspect ratio of from 2 to about 200.

U.S. application Ser. No. 12/033,247, U.S. Publication No. 20090208859, filed Feb. 19, 2008, entitled Anticurl Backside Coating (ACBC) Photoconductors, the disclosure of which is totally incorporated herein by reference, discloses a photoconductor comprising a first layer, a supporting substrate thereover, a photogenerating layer, and at least one charge transport layer comprised of at least one charge transport component, and wherein the first layer is in contact with the supporting substrate on the reverse side thereof, and which first layer is comprised of a fluorinated poly(oxetane) polymer.

U.S. application Ser. No. 12/033,279, U.S. Publication No. 20090208858, filed Feb. 19, 2008, entitled Backing Layer Containing Photoconductor, the disclosure of which is totally incorporated herein by reference, illustrates a photoconductor comprising a substrate, an imaging layer thereon, and a backing layer located on a side of the substrate opposite the imaging layer wherein the outermost layer of the backing layer adjacent to the substrate is comprised of a self crosslinked acrylic resin and a crosslinkable siloxane component.

BACKGROUND

This disclosure is generally directed to photoreceptors, photoconductors, xerographic imaging members, and the like. More specifically, the present disclosure is directed to multilayered drum, or flexible belt imaging members, or devices comprised of a first layer, a supporting medium like a substrate, a photogenerating layer, and a charge transport layer, including a plurality of charge transport layers, such as a first charge transport layer and a second charge transport layer, an optional adhesive layer, an optional hole blocking or undercoat layer, and an optional overcoat layer, and wherein the supporting substrate is situated between the first layer and the photogenerating layer. More specifically, the photoconductors disclosed, which in embodiments permit acceptable anticurl characteristics in combination with excellent conductivity, prolonged wear, surface slipperiness, and scratch resistant characteristics, contain a first backside coating layer or curl deterring backside coating layer (ACBC), and which layer is in contact with and contiguous to the reverse side of the supporting substrate, that is this side of the substrate that is not in contact with the photogenerating layer, and which first layer, or ACBC layer of the present disclosure, is comprised of a polyurethane, and optionally where the polyurethane can be deposited on a polymer layer, such as a polycarbonate.

The backside coating layer illustrated herein can be efficiently prepared, and in embodiments, the ACBC coating layer has excellent wear resistance, extended lifetimes, minimal dust and charge buildup, excellent bulk conductivity, possesses antistatic properties, acceptable surface resistivities, such as a surface resistivity of from about $10^7$ to about $10^{10}$ ohm/sq., and permit the elimination or minimization of photoconductive imaging member belt ACBC scratches.

The ACBC layer of the present disclosure, in embodiments, possesses a slippery surface, thus the wear resistance of this layer is excellent, especially as compared to an ACBC layer without any polyurethane, or an ACBC layer containing a polytetrafluoroethylene (PTFE). Also, a coating dispersion containing the polyurethane component is stable for extended time periods; minimal agglomeration of the ACBC layer components is provided, thereby increasing the coating uniformity of this layer; and other advantages as illustrated herein for photoconductors with ACBC layers comprising a polyurethane component.

More specifically, there is disclosed a photoconductor that includes an ACBC layer comprised of self conducting polyurethane with, for example, a surface resistivity of from about $10^7$ to about $10^{10}$ ohm/sq, and where the addition to the ACBC layer of conventional conductive components, such as carbon black, carbon nanotube, or metal oxide, are avoided, which polyurethane is comprised of a dendritic or branched polyester polyol and a polyisocyanate, and more specifically, a blocked polyisocyanate, or in embodiments a polyurethane ACBC layer formed by the reaction of a dendritic polyester polyol and a blocked polyisocyanate.

The disclosed polyurethane ACBC layer further comprises a siloxane component or a fluoro component, which co-crosslinks with the resin blend and provides the ACBC with slippery characteristics, and where slipperiness of the disclosed homogeneous ACBC layer can be adjusted by varying the amount of the siloxane or fluoro component selected.

In some instances, when a flexible layered photoconductor belt is mounted over a belt support module comprising various supporting rollers and backer bars present in a xerographic imaging apparatus, the anticurl or reduction in curl backside coating (ACBC), functioning under a normal xerographic machine operation condition, is repeatedly subjected to mechanical sliding contact against the apparatus backer bars and the belt support module rollers to thereby adversely impact the ACBC wear characteristics. Moreover, with a number of known prior art ACBC photoconductor layers formulated, the mechanical interactions against the belt support module components can decrease the lifetime of the photoconductor primarily because of wear and degradation after short time periods.

In embodiments, the photoconductors disclosed include an ACBC (anticurl backside coating) layer on the reverse side of the supporting substrate of a belt photoreceptor. The ACBC layer, which can be solution coated, for example, as a self-adhesive layer on the reverse side of the substrate of the photoconductor, comprises known suitable polyurethane components, such as commercially available polyurethanes, that, for example, substantially reduce surface contact friction, minimize or avoid curl, and prevent or minimize wear/scratch problems for the photoconductor. In embodiments, the mechanically robust ACBC layer of the present disclosure usually will not substantially reduce the layers thickness over extended time periods adversely affecting its anticurl ability for maintaining effective imaging member belt flatness while minimizing the formation of dirt and debris.

High surface contact friction of the backside coating against xerographic machines, such as printers, and its subsystems can cause the development of undesirable electrostatic charge buildup. In a number of instances, with devices, such as printers, the electrostatic charge builds up because of high contact friction between the anticurl backside coating and the backer bars which increases the frictional force to the point that it requires higher torque from the driving motor to pull the belt for effective cycling motion. In a full color electrophotographic apparatus using a 10-pitch photoreceptor belt, this electrostatic charge buildup can be high due to the large number of backer bars used in the machine. These and other disadvantages are minimized or avoided with the polyurethane containing photoconductors illustrated herein in embodiments.

Yet more specifically, there is desired an ACBC containing photoconductor with intrinsic properties that minimize or eliminate charge accumulation in the photoconductor without sacrificing other electrical properties and also possessing low surface energy characteristics. One known ACBC design can be designated as an insulating polymer coating containing additives, such as silica, PTFE or TEFLON®, in an attempt to reduce friction against backer plates and rollers, but these additives tend to charge up triboelectrically due to their rubbing against the plates resulting in an electrostatic drag force that adversely affects the process speed of the photoconductor.

Belt modules that incorporate sliding positioning supports like production xerographic printing machines generate a large amount of electric charge from the sliding contact that is discharged by the use of a somewhat costly combination of a carbon fiber brush and a bias power supply. Failure to discharge the ACBC layer produces an electrostatic attractive force between the photoreceptor and the support element which increases the normal force producing more drag which complicates photoreceptor belt removal, and can become large enough to stall or render inoperative the drive motor. In addition, the multiple points of sliding contact generate a significant quantity of fine polymer dust which coats the machine components and acts as a lubricant, reducing drive roller capacity. These and other related disadvantages are minimized in embodiments, with the ACBC containing photoconductors disclosed herein.

Also included within the scope of the present disclosure are methods of imaging and printing with the photoresponsive or photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the toner image to a suitable image receiving substrate, and permanently affixing the image thereto. In those environments wherein the device is to be used in a printing mode, the imaging method involves the same operation with the exception that exposure can be accomplished with a laser device or image bar. More specifically, the flexible photoconductor belts disclosed herein can be selected for the Xerox Corporation iGEN® machines that generate with some versions over 100 copies per minute. Processes of imaging, especially xerographic imaging and printing, including digital and/or color printing, are thus encompassed by the present disclosure. The imaging members are, in embodiments, sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

References

Anticurl backside coating formulations are disclosed in U.S. Pat. Nos. 5,069,993; 5,021,309; 5,919,590; and 4,654,284. Photoconductors containing ACBC layers are illustrated in U.S. Pat. Nos. 5,096,795; 5,935,748; 6,303,254; 6,528,226; and 6,939,652.

In U.S. Pat. No. 4,587,189, there is illustrated a layered imaging member with, for example, a perylene, pigment photogenerating component and an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members or photoconductors of the present disclosure in embodiments thereof.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises as a first step hydrolyzing a gallium phthalocyanine precursor pigment by dissolving the hydroxygallium phthalocyanine in a strong acid, and then reprecipitating the resulting dissolved pigment in basic aqueous media. Also, processes for the preparation of photogenerating pigments of hydroxygallium phthalocyanine are illustrated in U.S. Pat. No. 5,473,064, the disclosure of which is totally incorporated herein by reference.

The appropriate components, such as the supporting substrates, the photogenerating layer components, the charge transport layer components, the overcoating layer components, and the like, of the above-recited patents may be selected for the photoconductors of the present disclosure in embodiments thereof.

SUMMARY

Disclosed are imaging members containing a mechanically robust ACBC layer that possesses many of the advantages illustrated herein, such as extended lifetimes of the ACBC photoconductor such as, for example, in excess, it is believed, of about 2,000,000 simulated xerographic imaging cycles, and which photoconductors are believed to exhibit ACBC wear and scratch resistance characteristics.

Also disclosed are photoconductors containing a slippery and conductive ACBC layer that minimizes charge accumulations, and with a surface resistivity range of from about $10^7$ to about $10^{10}$ ohm/sq.

Additionally disclosed are flexible belt imaging members comprising the disclosed ACBC, and an optional hole blocking layer or layers comprised of, for example, aminosilanes, metal oxides, phenolic resins, and optional phenolic compounds, and which phenolic compounds contain at least two, and more specifically, two to ten phenol groups or phenolic resins with, for example, a weight average molecular weight ranging from about 500 to about 3,000, permitting, for example, a hole blocking layer with excellent efficient electron transport which usually results in a desirable photoconductor low residual potential $V_{low}$.

Embodiments

Aspects of the present disclosure relate to a photoconductor comprising a backing layer, a supporting substrate thereover, a photogenerating layer, and a charge transport layer comprised of at least one charge transport component, and wherein the backing layer is in contact with the supporting substrate on the reverse side thereof, and wherein the backing layer is comprised of a polyurethane comprised of a dendritic polyester polyol and a polyisocyanate; a photoconductor comprised of a single backing layer, and thereover a supporting substrate, a photogenerating layer, a charge transport layer, and wherein the backing layer is comprised of a conductive polyurethane, for example where the surface resistivity thereof is from or between about $10^7$ to about $10^{10}$ ohm/sq, of a polyester polyol and a polyisocyanate; a photoconductor comprised of a first backing layer and thereover a second backing layer; and in sequence thereover a supporting substrate, a photogenerating layer, and a charge transport layer, and wherein the first layer of the backing layer is adjacent to the substrate, and is comprised of a polycarbonate, and the second layer of the backing layer is situated on top of the first layer, and is comprised of a self conducting polyurethane of a branched polyester polyol and a polyisocyanate; a photoconductor comprising a first layer, a flexible supporting substrate thereover, a photogenerating layer, and at least one charge transport layer comprised of at least one charge transport component, and wherein the first layer, which is an anticurl backside coating (ACBC) that, for example, minimizes curl, is in contact with the supporting substrate on the reverse side thereof, and which first layer is comprised of a polyurethane component of a polyester polyol, and more specifically, a branched or dendritic polyester polyol and a polyisocyanate, or where the ACBC polyurethane is formed by the reaction of a dendritic polyester polyol and a polyisocyanate, especially a blocked polyisocyanate, thereover a supporting substrate, a photogenerating layer, and at least one charge transport layer comprised of at least one charge transport component; a flexible photoconductive imaging member comprised in sequence of the ACBC layer illustrated herein, adhered to the reverse side of a supporting substrate, a supporting substrate, a photogenerating layer thereover, a charge transport layer, and a protective top overcoat layer; and a photoconductor which includes a hole blocking layer and an adhesive layer where the adhesive layer is situated between the hole blocking layer and the photogenerating layer, and the hole blocking layer is situated between the substrate and the adhesive layer.

In embodiments, there is disclosed a photoconductor comprising a first ACBC layer with, for example, a thickness of from about 1 to about 30, from about 1 to about 20, from about 1 to about 10, from about 5 to about 30, from about 6 to about 30 microns (from about throughout includes values in between the ranges recited, for example from about 6 to about 30 includes all values in between 6 and 30, such as 6, 7, 8, 9, 10, 11, 12, 13, 14 up to 30), a supporting substrate thereover, a photogenerating layer, and a charge transport layer comprised of at least one charge transport component, and wherein the first layer is in contact with the supporting substrate on the reverse side thereof, and which first layer is comprised of a suitable polyurethane; a photoconductor comprised in sequence of a supporting substrate, a photogenerating layer thereover, and a charge transport layer, and wherein the substrate includes on the reverse side thereof an ACBC crosslinked polyurethane layer deposited on a polycarbonate polymer; and a photoconductor comprised in sequence of a supporting substrate, a photogenerating layer thereover, and a hole transport layer, and wherein the substrate includes on the reverse side an ACBC layer comprised of a suitable known polyurethane dispersed in a suitable material, such as for example disclosed herein, and more specifically, where the photogenerating layer is in contact with the surface of the supporting substrate, and the ACBC layer is in contact with the supporting substrate opposite the surface.

Embodiments include an imaging member comprising a substrate, an imaging layer thereon, and an ACBC layer located on a side of the substrate opposite to the imaging layer, wherein the ACBC layer comprises at least one single layer, or two layers, and the single layer or the top layer of the two layers or the outermost exposed layer comprises a backing material of a crosslinked polyurethane component as illustrated herein.

Aspects of the present disclosure relate to a photoconductor comprising a supporting media like a supporting substrate, an imaging layer thereon, and a backing layer located on a side of the substrate opposite the imaging layer wherein the outermost layer of the backing layer adjacent to the substrate is comprised of the polyurethane component illustrated herein, and the imaging layer is comprised of a photogenerating layer, and thereover a charge transport layer; a photoconductor comprised of a single backing layer situated thereover, and in contact with a supporting substrate, a photogenerating layer, and a charge transport layer, and wherein the backing layer is comprised of the reaction product of a dendritic polyester polyol and a blocked polyisocyanate; and a photoconductor comprised of a first backing layer and thereover a second backing layer, and in sequence thereover a supporting substrate, a photogenerating layer, a charge transport layer, and wherein the first layer of the backing layer is adjacent to the substrate, and the first layer is comprised of a polycarbonate, and the second layer of the backing layer is situated on top of the first layer, and is comprised of a crosslinked polyurethane of a suitable polyester polyol, a catalyst, and a polyisocyanate.

In various embodiments, the ACBC layer has a thickness as illustrated herein and from about 1 to about 100 microns, from about 5 to about 50, from about 5 to about 30, from about 6 to about 30 microns, or from about 10 to about 30 microns. In a two layer ACBC layer, the bottom layer adjacent to the substrate has a thickness, for example, of from about 0.9 to about 99.9 microns, from about 5 to about 50 microns, or from about 10 to about 30 microns, and the top layer has a thickness of, for example, from about 0.1 to about 20 microns, from about 1 to about 10 microns, or from about 2 to about 6 microns.

ACBC Layer Component Examples

The ACBC layer is, in embodiments, comprised of a self conducting polyurethane, that is where the addition of a conductive component like carbon black can be avoided, and which ACBC layer has a surface resistivity of, for example, from about $10^7$ to about $10^{12}$ ohm/sq, from about $10^8$ to about $10^{12}$ ohm/sq, or from about $10^8$ to about $10^{10}$ ohm/sq as measured by a High Resistivity Meter (Hiresta-Up MCP-HT450 available from Mitsubishi Chemical Corp.), which polyurethane is formed by the reaction of a dendritic polyester polyol, an optional catalyst, and a blocked polyisocyanate, or which ACBC layer is comprised of a branched polyester polyol, a catalyst, and a blocked polyisocyanate, and optionally where a thin, for example from about 1 to about 7 microns in thickness, ACBC layer can be coated or deposited on a polycarbonate.

Examples of polyester polyols selected for the ACBC layer, and, in embodiments, for reaction with the polyisocyanate are known, and can be obtained from Perstorp Specialty Chemicals (Perstorp, Sweden) as BOLTORN® P500 (OH value of 560 to 630 milligram KOH/gram, $M_w$(GPC)=1,800), P1000 (OH value of 430 to 490 mg KOH/grams, $M_w$ (GPC)=1,500), H20 (OH value of 490 to 520 mg KOH/grams, $M_w$ (GPC)=2,100, $T_g$=25° C.), H2003 (OH value of 280 to 310 mg KOH/grams, $M_w$ (GPC)=2,500, $T_g$=−5° C.), H2004 (OH value of 110 to 130 mg KOH/grams, $M_w$ (GPC)=3,200, $T_g$=−35° C.), H30 (OH value of 490 to 510 mg KOH/grams, $M_w$ (GPC)=3,500, $T_g$=35° C.), H40 (OH value of 470 to 500 mg KOH/grams, $M_w$ (GPC)=5,100, $T_g$=40° C.), U3000 (OH value of 77 mg KOH/grams, $M_w$ (GPC)=6,500), and W3000 (OH value of 45 mg KOH/grams, $M_w$ (GPC)=10,000). In embodiments, a dendritic polyester polyol selected for the ACBC layer formation can be formed by, for example, the polymerization of a core such as trimethylolpropane and branches extending therefrom of 2,2-dimethylol propionic acid (Bis-MPA), and which resulting products can be referred to as hydroxyl-functional dendritic polyesters.

Examples of polyisocyanates that can be included in the ACBC layer or for reaction with the dendritic polyester polyols are, for example, blocked polyisocyanates, available from Bayer of Germany, including DESMODUR® BL 3175A (aliphatic blocked polyisocyanate based on hexamethylene diisocyanate; blocked NCO content of 11.1 percent; solids of 75 percent±2 percent; viscosity of 3,000±1,000 mPa*s at 25° C.), 3272 MPA (aliphatic blocked polyisocyanate based on hexamethylene diisocyanate; blocked NCO content of 10.2 percent; solids of 72 percent±2 percent; viscosity of 2,400±750 mPa*s at 23° C.), 3370 MPA (aliphatic blocked polyisocyanate based on hexamethylene diisocyanate; blocked NCO content of 8.9 percent; solids of 70 percent±3 percent; viscosity of 3,500±1,200 mPa*s at 23° C.), 3475 BA/SN (aliphatic blocked polyisocyanate based on hexamethylene diisocyanate; blocked NCO content of 8.2 percent; solids of 75 percent±2 percent; viscosity of 1,000±300 mPa*s at 23° C.), 3575 MPA/SN (aliphatic blocked polyisocyanate based on hexamethylene diisocyanate; blocked NCO content of 10.5 percent; solids of 75 percent±2 percent; viscosity of 3,600±1,000 mPa*s at 25° C.), 4265 SN (aliphatic blocked polyisocyanate based on isophorone diisocyanate; blocked NCO content of 8.1 percent; solids of 65 percent±2 percent; viscosity of 11,000±3,000 mPa*s at 23° C.), 1265 MPA/X (aromatic blocked polyisocyanate based on toluene diisocyanate; blocked NCO content of 4.8 percent; solids of 65 percent±2 percent; viscosity of 20,000±5,000 mPa*s at 25° C.), and the like, and mixtures thereof.

In embodiments, the blocked polyisocyanates selected for the formation of the ACBC layer are substantially inactive at temperatures below about 80° C., such as for example, from about 50 to about 79° C. and active at 80° C. to about 125° C. It is believed that the blocked polyisocyanates are inactive at low temperatures as illustrated herein since the isocyanate functional groups are protected, while at higher temperatures of above 80° C. the protecting groups or groups are dissociated thereby exposing the functional groups, which are then reacted with the hydroxyl groups of the polyol to form the polyurethane. The use of a catalyst, which is optional, accelerates the achievement of crosslinking during the reaction of the dendritic polyester polyol and the polyisocyanate thereby resulting in a crosslinked polymer.

The disclosed polyurethane ACBC layer, in embodiments, was formed by reacting and heating a dendritic polyester polyol, selected in an amount of, for example, from about 10 to about 90 weight percent, or from about 50 to about 80 weight percent of the total ACBC layer, with a blocked polyisocyanate, selected in an amount of, for example, from about 90 to about 10 weight percent, or from about 50 to about 20 weight percent of the total ACBC layer. The polyurethane formation occurred at temperatures of, for example, from about 80° C. to about 200° C., or from about 100° C. to about 150° C., and which temperatures were maintained for periods of, for example, from about 5 to about 120 minutes, or from about 10 to about 60 minutes. In embodiments, from about 30 to about 70 weight percent of the branched polyester polyol is reacted with from about 70 to about 30 weight percent of the blocked polyisocyanate in the presence of from about 0.01 to about 1 weight percent of the catalyst at a temperature of from about 100° C. to 200° C. for a period of from about 5 to about 120 minutes, followed by cooling to room temperature, then isolating and identifying the product.

The ACBC layer may be formed in the presence of a catalyst or may further include a catalyst such as an organotin compound, such as dibutyltin dilaurate, dioctyltin mercaptide, dibutyltin oxide, and other suitable catalysts, selected in an amount of, for example, from about 0.01 to about 10 weight percent, or from about 0.1 to about 1 weight percent of the total ACBC layer, and which catalyst assists in the formation of a crosslinked ACBC layer components, and where ACBC layer possesses a crosslinking density of, for example, from about 50 to about 95 percent, or from about 70 to about 90 percent as determined by known processes, such as FTIR analysis. In embodiments, the hydroxyl groups of the dendritic polyester polyol react with the isocyanate groups of the polyisocyanate to form urethane bonds.

Optionally, the disclosed ACBC layer further includes polyols, such as acrylic polyols, present in an amount of, for example, from about 10 to about 80 weight percent, or from about 30 to about 60 weight percent of the total ACBC layer. In embodiments, acrylic polyol examples include copolymers of derivatives of acrylic and methacrylic acid including acrylic and methacrylic esters, and compounds containing nitrile and amide groups, and other optional monomers. The acrylic esters can be selected from, for example, the group consisting of n-alkyl acrylates wherein alkyl contains, in embodiments, from 1 to about 25 carbon atoms, such as methyl, ethyl, propyl, butyl, pentyl, hexyl, heptyl, octyl, nonyl, decyl, dodecyl, tetradecyl, or hexadecyl acrylate; secondary and branched-chain alkyl acrylates such as isopropyl, isobutyl, sec-butyl, 2-ethylhexyl, or 2-ethylbutyl acrylate; olefinic acrylates such as allyl, 2-methylallyl, furfuryl, or 2-butenyl acrylate; aminoalkyl acrylates such as 2-(dimethylamino)ethyl, 2-(diethylamino)ethyl, 2-(dibutylamino)ethyl, or 3-(diethylamino)propyl acrylate; ether acrylates such as 2-methoxyethyl, 2-ethoxyethyl, tetrahydrofurfuryl, or 2-butoxyethyl acrylate; cycloalkyl acrylates such as cyclohexyl, 4-methylcyclohexyl, or 3,3,5-trimethylcyclohexyl acrylate; halogenated alkyl acrylates such as 2-bromoethyl, 2-chloroethyl, or 2,3-dibromopropyl acrylate; glycol acrylates and diacrylates such as ethylene glycol, propylene glycol, 1,3-propanediol, 1,4-butanediol, diethylene glycol, 1,5-pentanediol, triethylene glycol, dipropylene glycol, 2,5-hexanediol, 2,2-diethyl-1,3-propanediol, 2-ethyl-1,3-hexanediol, or 1,10-decanediol acrylate, and diacrylate. Examples of methacrylic esters can be selected from, for example, the group consisting of alkyl methacrylates such as methyl, ethyl, propyl, isopropyl, n-butyl, isobutyl, sec-butyl, t-butyl, n-hexyl, n-octyl, isooctyl, 2-ethylhexyl, n-decyl, or tetradecyl methacrylate; unsaturated alkyl methacrylates such as vinyl, allyl, oleyl, or 2-propynyl methacrylate; cycloalkyl methacrylates such as cyclohexyl, 1-methylcyclohexyl, 3-vinylcyclohexyl, 3,3,5-trimethylcyclohexyl, bornyl, isobornyl, or cyclopenta-2,4-dienyl methacrylate; aryl methacrylates such as phenyl, benzyl, or nonylphenyl methacrylate; hydroxyalkyl methacrylates such as 2-hydroxyethyl, 2-hydroxypropyl, 3-hydroxypropyl, or 3,4-dihydroxybutyl methacrylate; ether methacrylates such as methoxymethyl, ethoxymethyl, 2-ethoxyethoxymethyl, allyloxymethyl, benzyloxymethyl, cyclohexyloxymethyl, 1-ethoxyethyl, 2-ethoxyethyl, 2-butoxyethyl, 1-methyl-(2-vinyloxy)ethyl, methoxymethoxyethyl, methoxyethoxyethyl, vinyloxyethoxyethyl, 1-butoxypropyl, 1-ethoxybutyl, tetrahydrofurfuryl, or furfuryl methacrylate; oxiranyl methacrylates such as glycidyl, 2,3-epoxybutyl, 3,4-epoxybutyl, 2,3-epoxycyclohexyl, or 10,11-epoxyundecyl methacrylate; aminoalkyl methacrylates such as 2-dimethylaminoethyl, 2-diethylaminoethyl, 2-t-octylaminoethyl, N,N-dibutylaminoethyl, 3-diethylaminopropyl, 7-amino-3,4-dimethyloctyl, N-methylformamidoethyl, or 2-ureidoethyl methacrylate; glycol dimethacrylates such as methylene, ethylene glycol, 1,2-propanediol, 1,3-butanediol, 1,4-butanediol, 2,5-dimethyl-1,6-hexanediol, 1,10-decanediol, diethylene glycol, or triethylene glycol dimethacrylate; trimethacrylates such as trimethylolpropane trimethacrylate; carbonyl-containing methacrylates such as carboxymethyl, 2-carboxyethyl, acetonyl, oxazolidinylethyl, N-(2-methacryloyloxyethyl)-2-pyrrolidinone, N-methacryloyl-2-pyrrolidinone, N-(metharyloyloxy)formamide, N-methacryloylmorpholine, or tris(2-methacryloxyethyl)amine methacrylate; other nitrogen-containing methacrylates such as 2-methacryloyloxyethylmethyl cyanamide, methacryloyloxyethyl trimethylammonium chloride, N-(methacryloyloxy-ethyl)diisobutylketimine, cyanomethyl, or 2-cyanoethyl methacrylate; halogenated alkyl methacrylates such as chloromethyl, 1,3-dichloro-2-propyl, 4-bromophenyl, 2-bromoethyl, 2,3-dibromopropyl, or 2-iodoethyl methacrylate; sulfur-containing methacrylates such as methylthiol, butylthiol, ethylsulfonylethyl, ethylsulfinylethyl, thiocyanatomethyl, 4-thiocyanatobutyl, methylsulfinylmethyl, 2-dodecylthioethyl methacrylate, or bis(methacryloyloxyethyl)sulfide; phosphorous-boron-silicon-containing methacrylates such as 2-(ethylenephosphino)propyl, dimethylphosphinomethyl, dimethylphosphonoethyl, diethylphosphatoethyl, 2-(dimethylphosphato)propyl, 2-(dibutylphosphono)ethyl methacrylate, diethyl methacryloylphosphonate, dipropyl methacryloyl phosphate, diethyl methacryloyl phosphite, 2-methacryloyloxyethyl diethyl phosphite, 2,3-butylene methacryloyl-oxyethyl borate, or methyldiethoxymethacryloyloxyethoxysilane. Methacrylic amides and nitriles can be selected from the group consisting of at least one of N-methylmethacrylamide, N-isopropylmethacrylamide, N-phenylmethacrylamide, N-(2-hydoxyethyl)methacrylamide, 1-methacryloylamido-2-methyl-2-propanol, 4-methacryloylamido-4-methyl-2-pentanol, N-(methoxymethyl)methacrylamide, N-(dimethylaminoethyl)methacrylamide, N-(3-dimethylaminopropyl)methacrylamide, N-acetylmethacrylamide, N-methacryloylmaleamic acid, methacryloylamido acetonitrile, N-(2-cyanoethyl) methacrylamide, 1-methacryloylurea, N-phenyl-N-phenylethylmethacrylamide, N-(3-dibutylaminopropyl)methacrylamide, N,N-diethylmethacrylamide, N-(2-cyanoethyl)-N-methylmethacrylamide, N,N-bis(2-diethylaminoethyl) methacrylamide, N-methyl-N-phenylmethacrylamide, N,N'-methylenebismethacrylamide, N,N'-ethylenebismethacrylamide, or N-(diethylphosphono) methacrylamide. Further optional monomer examples are styrene, acrolein, acrylic anhydride, acrylonitrile, acryloyl chloride, methacrolein, methacrylonitrile, methacrylic anhydride, methacrylic acetic anhydride, methacryloyl chloride, methacryloyl bromide, itaconic acid, butadiene, vinyl chloride, vinylidene chloride, or vinyl acetate.

Specific examples of acrylic polyols selected for the ACBC layer include PARALOID™ AT-410 (acrylic polyol, 73 percent in methyl amyl ketone, $T_g$=30° C., OH equivalent weight=880, acid number=25, $M_w$=9,000), AT-400 (acrylic polyol, 75 percent in methyl amyl ketone, $T_g$=15° C., OH equivalent weight=650, acid number=25, $M_w$=15,000), AT-746 (acrylic polyol, 50 percent in xylene, $T_g$=83° C., OH equivalent weight=1,700, acid number=15, $M_w$=45,000), AE-1285 (acrylic polyol, 68.5 percent in xylene/butanol=70/30, $T_g$=23° C., OH equivalent weight=1,185, acid number=49, $M_w$=6,500), and AT-63 (acrylic polyol, 75 percent in methyl amyl ketone, $T_g$=25° C., OH equivalent weight=1,300, acid number=30), all available from Rohm and Haas, Philadelphia, Pa.; JONCRYL™ 500 (styrene acrylic polyol, 80 percent in methyl amyl ketone, $T_g$=−5° C., OH equivalent weight=400), 550 (styrene acrylic polyol, 62.5 percent in PM-acetate/toluene=65/35, OH equivalent weight=600), 551 (styrene acrylic polyol, 60 percent in xylene, OH equivalent weight=600), 580 (styrene acrylic polyol, $T_g$=50° C., OH equivalent weight=350, acid number=10, $M_w$=15,000), 942 (styrene acrylic polyol, 73.5 percent in n-butyl acetate, OH equivalent weight=400), and 945 (styrene acrylic polyol, 78 percent in n-butyl acetate, OH equivalent weight=310), all available from Johnson Polymer, Sturtevant, Wis.; RU-1100-1k™ with a $M_n$ of 1,000 and 112 hydroxyl value, and RU-1550-k5™ with a $M_n$ of 5,000 and 22.5 hydroxyl value, both available from Procachem Corp.; G-CURE™ 108A70, available from Fitzchem Corp.; NEOL® polyol, available from BASF; TONE™ 0201 polyol with a $M_n$ of 530, a hydroxyl number of 117, and acid number of <0.25, available from Dow Chemical Company.

Optionally, the disclosed ACBC layer further comprises a siloxane component or a fluoro component, which co-crosslinks with the polyurethane, and for example, renders the ACBC layer robust with a low surface energy and slippery. In embodiments, the siloxane or fluoro component is present in an amount of from about 0.1 to about 20 weight percent, from about 1 to about 5 weight percent of the total ACBC layer components.

Examples of the siloxane component selected for the ACBC layer include hydroxyl derivatives of silicone modified polyacrylates such as BYK-SILCLEAN® 3700; polyether modified acryl polydimethylsiloxanes such as BYK-SILCLEAN® 3710; and polyether modified hydroxyl polydimethylsiloxanes such as BYK-SILCLEAN® 3720.

Examples of the fluoro component selected for the ACBC layer, include (1) hydroxyl derivatives (functionalized, for example, a hydroxyl derivative of a perfluoropolyoxyalkane is referred to as a hydroxyl functionalized perfluoropolyoxyalkane) of perfluoropolyoxyalkanes such as FLUOROLINK® D (M.W. of about 1,000 and a fluorine content of about 62 percent), FLUOROLINK® D10-H (M.W. of about 700 and fluorine content of about 61 percent), and FLUOROLINK® D10 (M.W. of about 500 and fluorine content of about 60 percent) (functional group—$CH_2OH$); FLUOROLINK® E (M.W. of about 1,000 and a fluorine content of about 58 percent), and FLUOROLINK® E10 (M.W. of about 500 and fluorine content of about 56 percent) (functional group—$CH_2(OCH_2CH_2)_nOH$); FLUOROLINK® T (M.W. of about 550 and fluorine content of about 58 percent), and FLUOROLINK® T10 (M.W. of about 330 and fluorine content of about 55 percent) (functional group —$CH_2OCH_2CH(OH)CH_2OH$); (2) hydroxyl derivatives of perfluoroalkanes ($R_fCH_2CH_2OH$, wherein $R_f$=$F(CF_2CF_2)_n$) wherein n represents the number of groups, such as about 1 to about 50, such as ZONYL® BA (M.W. of about 460 and fluorine content of about 71 percent), ZONYL® BA-L (M.W. of about 440 and fluorine content of about 70 percent), ZONYL® BA-LD (M.W. of about 420 and fluorine content of about 70 percent), and ZONYL® BA-N (M.W. of about 530 and fluorine content of about 71 percent); (3) carboxylic acid derivatives of fluoropolyethers such as FLUOROLINK® C (M.W. of about 1,000 and fluorine content of about 61 percent); (4) carboxylic ester derivatives of fluoropolyethers such as FLUOROLINK® L (M.W. of about 1,000 and fluorine content of about 60 percent), FLUOROLINK® L10 (M.W. of about 500 and fluorine content of about 58 percent); (5) carboxylic ester derivatives of perfluoroalkanes ($R_fCH_2CH_2O(C{=}O)R$, wherein $R_f$=$F(CF_2CF_2)_n$, and n is as illustrated herein, and R is alkyl) such as ZONYL® TA-N (fluoroalkyl acrylate, R=$CH_2$=CH—, M.W. of about 570 and fluorine content of about 64 percent), ZONYL® TM (fluoroalkyl methacrylate, R=$CH_2$=$C(CH_3)$—, M.W. of about 530 and fluorine content of about 60 percent), ZONYL® FTS (fluoroalkyl stearate, R=$C_{17}H_{35}$—, M.W. of about 700 and fluorine content of about 47 percent), ZONYL® TBC (fluoroalkyl citrate, M.W. of about 1,560 and fluorine content of about 63 percent); (6) sulfonic acid derivatives of perfluoroalkanes ($R_fCH_2CH_2SO_3H$, wherein $R_f$=$F(CF_2CF_2)_n$), and n is as illustrated herein, such as ZONYL® TBS (M.W. of about 530 and fluorine content of about 62 percent); (7) ethoxysilane derivatives of fluoropolyethers such as FLUOROLINK® S10 (M.W. of about 1,750 to about 1,950); and (8) phosphate derivatives of fluoropolyethers such as FLUOROLINK® F10 (M.W. of about 2,400 to about 3,100). The FLUOROLINK® additives are available from Ausimont USA, and the ZONYL® additives are available from E.I. DuPont.

In embodiments, the photoconductor disclosed herein may further comprise an adhesive layer located on the reverse side of the substrate between the backing layer and the substrate. The adhesive layer may comprise an adhesive material selected, for example, from the group consisting of silicone, rubber, acrylic, and the like.

In embodiments, the adhesive layer and the backing layer may be applied together as a laminated self-adhesive. For example, commercial tapes normally comprise a backing and an adhesive. Exemplary commercial tapes that may be selected are vinyl tape, masking tape, or electrical tape. These types of tapes are distinguished by various features. A vinyl tape comprises a vinyl backing and an adhesive. Masking tape that may be selected comprises a paper backing and an adhesive. Electrical tape that may be selected comprises a vinyl backing and an adhesive. The electrical tape backing may be nonconducting, that is insulating, though this property is not required for crack resistance. The backing may also have elastic properties, that is a reversible elastic elongation in the tensile direction. The electrical tape adhesive provides adhesion for long periods of time, such as from months to years. The electrical tape adhesive may also be selected so as to preferentially adhere to the electrical tape backing, that is it sticks to the backing, not the surface to which the tape is applied. These types of tape are not mutually exclusive; for example a tape can be a vinyl tape and an electrical tape. When desired, multiple ACBC layers may be applied to the reverse side of the imaging member. In particular, one or more laminated self-adhesive layers may be applied.

Examples of further additional components present in the ACBC layer are a number of known polymers and conductive components. Thus, the disclosed anticurl backside coating (ACBC) layer optionally further comprises, in embodiments, at least one polymer, which usually is the same polymer that is selected for the charge transport layer or layers. Examples of polymers present, for example, in an amount of from about 50 to about 99 weight percent, from about 70 to about 90 weight percent of the ACBC layer, include polycarbonates, polyarylates, acrylate polymers, vinyl polymers, cellulose polymers, polyesters, copolyesters, polysiloxanes, polyamides, polyurethanes, poly(cyclo olefins), epoxies, and copolymers thereof; and more specifically, polycarbonates such as poly(4,4'-isopropylidene-diphenylene)carbonate (also referred to as bisphenol-A-polycarbonate), poly(4,4'-cyclohexylidine diphenylene)carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, the polymeric binder is comprised of a polycarbonate resin with a weight average molecular weight of, for example, from about 20,000 to about 100,000, and more specifically, with a molecular weight $M_w$ of from about 50,000 to about 100,000.

When two layer ACBC layers are present, with the top layer being comprised of a branched polyester polyol, a polyisocyanate and a catalyst, or formed by the reaction thereof the polyester polyol, polyisocyanate, and catalyst with the bottom layer examples include polycarbonates, polyarylates, acrylate polymers, vinyl polymers, cellulose polymers, polyesters, copolyesters, polysiloxanes, polyamides, polyurethanes, poly(cyclo olefins), epoxies, and copolymers thereof; and more specifically, polycarbonates such as poly(4,4'-isopropylidene-diphenylene)carbonate (also referred to as bisphenol-A-polycarbonate), poly(4,4'-cyclohexylidine diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, the polymeric binder is comprised of a polycarbonate resin with a weight average molecular weight of, for example, from about 20,000 to about 100,000, and more specifically, with a weight average molecular weight $M_w$ of from about 50,000 to about 100,000.

Photoconductive Layer Components

There can be selected for the photoconductors disclosed herein a number of known layers, such as substrates, photogenerating layers, charge transport layers, hole blocking layers, adhesive layers, protective overcoat layers, and the like. Examples, thicknesses, and specific components of many of these layers include the following.

A number of known supporting substrates can be selected for the photoconductors illustrated herein, such as those substrates that will permit the layers thereover to be effective. The thickness of the photoconductor substrate layer depends on many factors, including economical considerations, electrical characteristics, adequate flexibility, and the like, thus this layer may be of substantial thickness, for example over 3,000 microns, such as from about 1,000 to about 2,000 microns, from about 500 to about 1,000 microns, or from about 300 to about 700 microns, ("about" throughout includes all values in between the values recited) or of a minimum thickness. In embodiments, the thickness of this layer is from about 75 microns to about 300 microns, or from about 100 to about 150 microns.

The photoconductor substrate may be opaque or substantially transparent, and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, this layer may be of a substantial thickness of, for example, up to many centimeters, or of a minimum thickness of less than a millimeter. Similarly, a flexible belt may be of a substantial thickness of, for example, about 250 microns, or of a minimum thickness of less than about 50 microns, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations such as, for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer such as, for example, polycarbonate materials commercially available as MAKROLON®.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 to about 10 microns, and more specifically, from about 0.25 to about 2 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations.

The photogenerating composition or pigment is present in the resinous binder composition in various amounts. Generally, however, from about 5 to about 95 percent by volume of the photogenerating pigment is dispersed in about 95 to about 5 percent by volume of the resinous binder, or from about 20 to about 30 percent by volume of the photogenerating pigment is dispersed in about 70 to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly(vinyl butyral), poly (vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium, and alloys of selenium and arsenic, tellurium, germanium, and the like, hydrogenated amorphous silicon, and compounds of silicon and germanium, carbon, oxygen, nitrogen, and the like fabricated by vacuum evaporation or deposition. The photogenerating layers may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder, and fabricated by solvent coating techniques.

In embodiments, examples of polymeric binder materials that can be selected as the matrix for the photogenerating layer are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene-butadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent coated layer may be effected by any known conventional techniques such as oven drying, infrared radiation drying, air drying, and the like.

The coating of the photogenerating layer in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30 microns, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer, and the photogenerating layer. Usually, the photogenerating layer is applied onto the blocking layer, and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary, and in embodiments is, for example, from about 0.05 to about 0.3 micron. The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an adhesive layer usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure, further desirable electrical and optical properties.

The optional hole blocking or undercoat layer for the imaging members of the present disclosure can contain a number of components including known hole blocking components, such as amino silanes, doped metal oxides, a metal oxide like titanium, chromium, zinc, tin, and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 to about 80 weight percent, and more specifically, from about 55 to about 65 weight percent of a suitable component like a metal oxide, such as $TiO_2$, from about 20 to about 70 weight percent, and more specifically, from about 25 to about 50 weight percent of a phenolic resin; from about 2 to about 20 weight percent, and more specifically, from about 5 to about 15 weight percent of a phenolic compound preferably containing at least two phenolic groups, such as bisphenol S, and from about 2 to about 15 weight percent, and more specifically, from about 4 to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion are added a phenolic compound and dopant, followed by mixing. The hole blocking layer coating dispersion can be applied by dip coating or web coating, and the layer can be thermally cured after coating. The hole blocking layer resulting is, for example, of a thickness of from about 0.01 to about 30 microns, and more specifically, from about 0.1 to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol, and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer), and the underlying conductive surface of substrate may be selected.

A number of charge transport compounds can be included in the charge transport layer, which layer generally is of a thickness of from about 5 to about 75 microns, and more specifically, of a thickness of from about 10 to about 40 microns. Examples of charge transport components are aryl amines as represented by

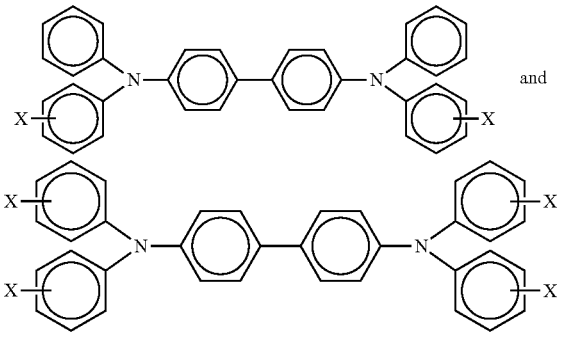

wherein X is a suitable hydrocarbon like alkyl, alkoxy, aryl, and derivatives thereof; a halogen, or mixtures thereof, and especially those substituents selected from the group consisting of Cl and $CH_3$; and components as represented by

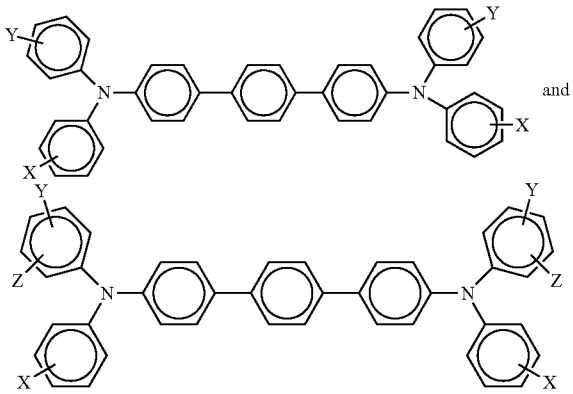

and wherein X, Y and Z are independently alkyl, alkoxy, aryl, a halogen, or mixtures thereof; and wherein at least one of Y and Z are present. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific charge transport components include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

In embodiments, the charge transport component can be represented by

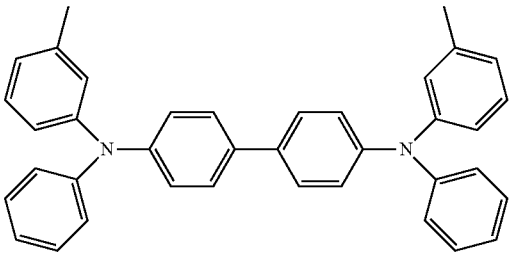

;

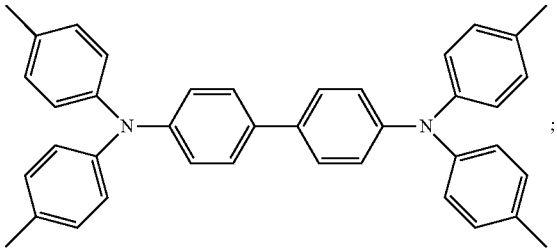

;

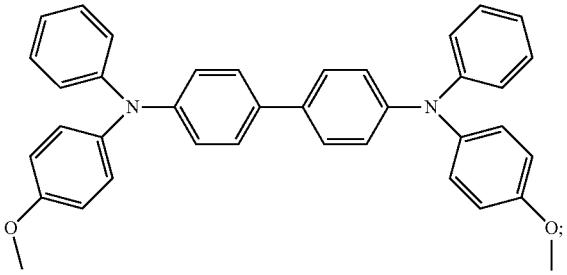

;

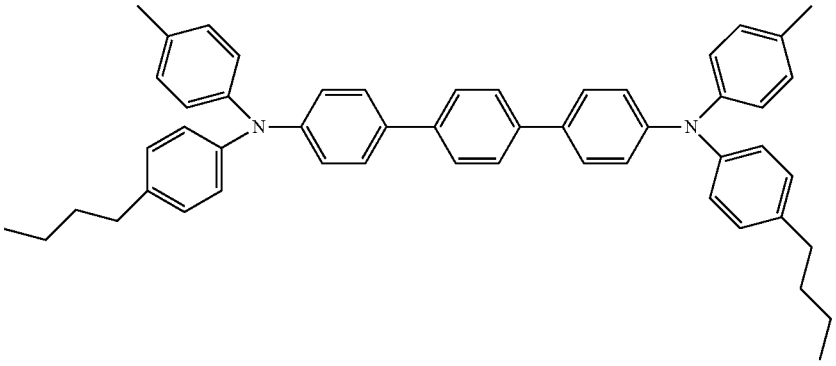

;

-continued

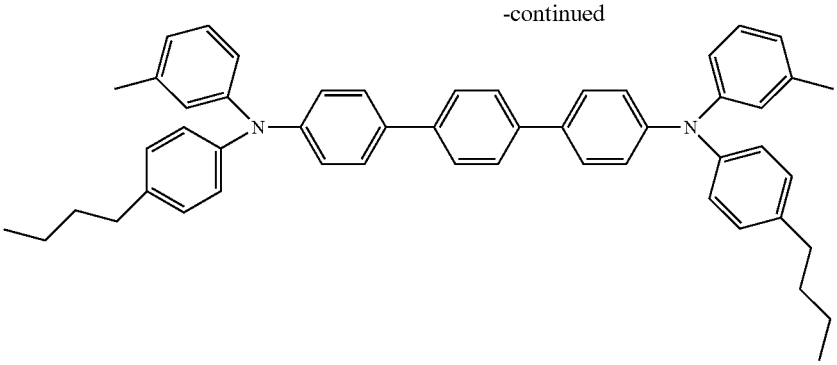

; and

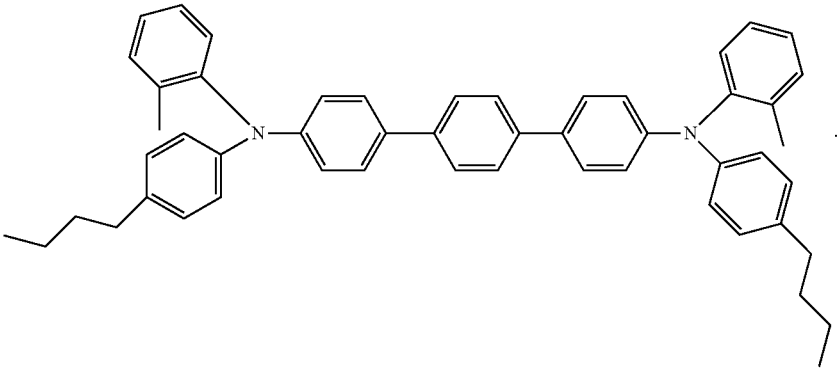

.

Examples of the binder materials selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene) carbonate (also referred to as bisphenol-A-polycarbonate), poly(4,4'-cyclohexylidine diphenylene)carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, "charge transport" refers, for example, to charge transporting molecules as a monomer that allows the free charge generated in the photogenerating layer to be transported across the transport layer.

Examples of the charge transport hole transporting molecules present, for example, in an amount of from about 50 to about 75 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N,'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone, and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments, to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency, and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-

4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material, or a combination of a small molecule charge transport material and a polymeric charge transport material.

Examples of components or materials optionally incorporated into the charge transport layers or at least one charge transport layer to, for example, enable excellent lateral charge migration (LCM) resistance include hindered phenolic antioxidants, such as tetrakis methylene(3,5-di-tert-butyl-4-hydroxy hydrocinnamate)methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent.

A number of processes may be used to mix and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each charge transport layer, in embodiments, is from about 10 to about 70 microns, but thicknesses outside this range may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported to selectively discharge a surface charge on the surface of the active layer. Typical application techniques include spraying, dip coating, roll coating, wire wound rod coating, and the like. Drying of the deposited coating may be effected by any suitable conventional technique, such as oven drying, infrared radiation drying, air drying, and the like. An optional top overcoating layer, such as the overcoating of copending U.S. application Ser. No. 11/593,875, Publication No. 20080107985, the disclosure of which is totally incorporated herein by reference, may be applied over the charge transport layer to provide abrasion protection.

Aspects of the present disclosure relate to a photoconductive imaging member comprised of a first ACBC layer, a second layer thereover of a supporting substrate, a photogenerating layer, a charge transport layer, and an overcoating charge transport layer; a photoconductive member with a photogenerating layer of a thickness of from about 0.1 to about 10 microns, and at least one transport layer, each of a thickness of from about 5 to about 100 microns; an imaging method and an imaging apparatus containing a charging component, a development component, a transfer component, and a fixing component, and wherein the apparatus contains a photoconductive imaging member comprised of a first ACBC layer as disclosed herein, a supporting substrate, and thereover a layer comprised of a photogenerating pigment and a charge transport layer or layers, and thereover an overcoating charge transport layer, and where the transport layer is of a thickness of from about 20 to about 75 microns; a member wherein the photogenerating layer contains a photogenerating pigment present in an amount of from about 5 to about 95 weight percent; a member wherein the thickness of the photogenerating layer is from about 0.1 to about 4 microns; a member wherein the photogenerating layer contains a photogenerating pigment and a polymer binder; a member wherein the photogenerating binder is present in an amount of from about 50 to about 90 percent by weight, and wherein the total of all layer components is about 100 percent; a member wherein the photogenerating component is a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; a photoconductor wherein each of the charge transport layers, such as 1, 2, or 3 layers, and especially 2 layers, comprises

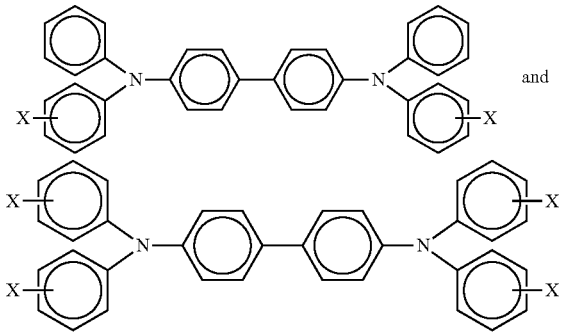

and wherein X is selected from the group consisting of alkyl, alkoxy, aryl, and halogen, and more specifically, methyl and halo; an imaging member wherein alkyl and alkoxy contains from about 1 to about 12 carbon atoms; an imaging member wherein alkyl contains from about 1 to about 7 carbon atoms;

an imaging member wherein alkyl is methyl; an imaging member wherein each of, or at least one of the charge transport layers comprises

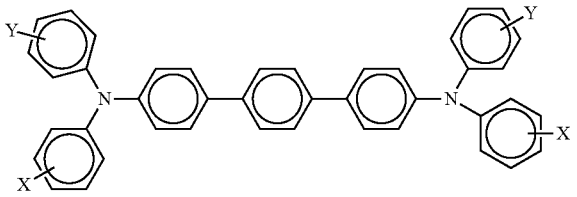

wherein X and Y are independently alkyl, alkoxy, aryl, a halogen, or mixtures thereof; an imaging member wherein alkyl and alkoxy contains from about 1 to about 12 carbon atoms; an imaging member wherein alkyl contains from about 1 to about 5 carbon atoms, and wherein the resinous binder is selected from the group consisting of polycarbonates and polystyrene; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on an imaging member developing the latent image, and transferring the developed electrostatic image to a suitable substrate; a method of imaging wherein the imaging member is exposed to light of a wavelength of from about 370 to about 950 nanometers; a photoconductive member wherein the photogenerating layer is situated between the substrate and the charge transport layer; a member wherein the charge transport layer is situated between the substrate and the photogenerating layer; a member wherein the photogenerating layer is of a thickness of from about 0.1 to about 50 microns; a member wherein the photogenerating component pigment amount is from about 0.5 to about 20 weight percent, and wherein the photogenerating pigment is optionally dispersed in from about 1 to about 80 weight percent of a polymer binder; a member wherein the binder is present in an amount of from about 50 to about 90 percent by weight, and wherein the total of the layer components is about 100 percent; an imaging member wherein the photogenerating component is Type V hydroxygallium phthalocyanine, or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the hole transport resinous binder is selected from the group consisting of polycarbonates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; a color method of imaging which comprises generating an electrostatic latent image on the imaging member, developing the latent image, transferring, and fixing the developed electrostatic image to a suitable substrate; photoconductive imaging members comprised of a supporting substrate, a photogenerating layer, a hole transport layer and a top overcoating layer in contact with the hole transport layer, or in embodiments in contact with the photogenerating layer, and in embodiments wherein a plurality of charge transport layers are selected, such as for example, from two to about ten, and more specifically, two may be selected; and a photoconductive imaging member comprised of an optional supporting substrate, a photogenerating layer, and a first, second, and third charge transport layer. In embodiments, at least one charge transport layer refers, for example, to 1, 2, 3, 4, 5, 6, or 7 layers, and especially 1 or 2 layers, and yet more specifically, 2 layers.

The following Examples are being submitted to illustrate embodiments of the present disclosure. While the crosslinking percentage value of the polymer ACBC layer product is difficult to measure, it is estimated to be about 90 percent.

Comparative Example 1

A belt photoconductor was prepared as follows.

There was coated a 0.02 micron thick titanium layer on a biaxially oriented polyethylene naphthalate substrate (KALEDEX™ 2000) having a thickness of 3.5 mils, and applying thereon, with a gravure applicator or an extrusion coater, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in a forced air dryer. The resulting hole blocking layer had a dry thickness of 500 Angstroms. An adhesive layer was then added by applying a wet coating over the blocking layer using a gravure applicator or an extrusion coater, and which adhesive contained 0.2 percent by weight based on the total weight of the solution of the copolyester adhesive (ARDEL™ D100 available from Toyota Hsutsu Inc.) in a 60:30:10 volume ratio mixture of tetrahydrofuran/monochlorobenzene/methylene chloride. The adhesive layer was then dried for about 1 minute at 120° C. in a forced air dryer. The resulting adhesive layer had a dry thickness of 200 Angstroms.

A photogenerating layer dispersion was prepared by introducing 0.45 gram of the known polycarbonate IUPILON™ 200 (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of the above polycarbonate PCZ-200 were dissolved in 46.1 grams of tetrahydrofuran, and added to the hydroxygallium phthalocyanine dispersion. The resulting slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer, and the adhesive layer was deliberately left uncoated by any of the photogenerating layer material to facilitate adequate electrical contact by the known ground strip layer that was applied later. The photogenerating layer was dried at 120° C. for 1 minute in a forced air oven to form a dry photogenerating layer having a thickness of 0.4 micron.

The resulting photoconductor was overcoated with a charge transport layer that was in contact with the photogenerating layer, which charge transport layer was prepared by introducing into an amber glass bottle in a weight ratio of 1:1 N,N'-diphenyl-N,N'-bis(3-methylphenyl)-1,1'-biphenyl-4,4'-diamine, and poly(4,4'-isopropylidene diphenyl) carbonate, a known bisphenol A polycarbonate having a $M_w$ molecular weight average of about 120,000, commercially available from Farbenfabriken Bayer A.G. as MAKROLON® 5705. The resulting mixture was then dissolved in methylene chloride to form a solution containing 15 percent by weight solids. This solution was applied on the photogenerating layer to form the bottom layer coating that upon drying (120° C. for 1 minute) had a thickness of 14.5 microns. During this coating process, the humidity was equal to about 15 percent.

In embodiments, the above charge transport layer (bottom layer) can be overcoated with a top charge transport layer. The charge transport layer solution of the top layer was prepared as described above for the bottom layer. This solution was applied on the bottom layer of the charge transport layer to form a coating that upon drying (120° C. for 1 minute) had a thickness of 14.5 microns. During this coating process, the humidity was equal to or less than 15 percent.

An anticurl backside coating layer (ACBC) coating solution was prepared by introducing into an amber glass bottle in a weight ratio of 8:92 VITEL® 2200, a copolyester of iso/terephthalic acid, dimethylpropanediol, and ethanediol with a copolyester melting point of from about 302° C. to about 320° C. (degrees Centigrade), commercially available from Shell Oil Company, Houston, Tex., and MAKROLON® 5705, a known polycarbonate resin having a $M_w$ molecular weight average of from about 50,000 to about 100,000, commercially available from Farbenfabriken Bayer A.G. The resulting mixture was then dissolved in methylene chloride to form a solution containing 9 percent by weight solids. This solution was applied on the back of the above PEN (KALEDEX™ 2000) substrate of the belt photoconductor to form a coating of the anticurl backside coating layer of VITEL® 2200/MAKROLON® 5705 at a ratio of 8/92 that upon drying (120° C. for 1 minute) had a thickness of 17.4 microns. During this coating process, the humidity was about 15 percent.

Example I

A photoconductor was prepared by repeating the process of Comparative Example 1 except that the ACBC layer solution was prepared by introducing into an amber glass bottle in a weight ratio of 70/29/1 P1000, a dendritic polyester polyol, OH value of 430 to 490 mg KOH/grams, $M_w$ (GPC)=1,500, commercially available from Perstorp Specialty Chemicals, Perstorp, Sweden; DESMODUR® BL 3175A, an aliphatic blocked polyisocyanate based on hexamethylene diisocyanate, blocked NCO content of 11.1 percent, solids of 75 percent±2 percent, viscosity of 3,000±1,000 mPa*s at 25° C., commercially available from Bayer of Germany; and dibutyltin dilaurate, an organotin catalyst. The resulting mixture was then applied on the back of a substrate of a biaxially oriented polyethylene naphthalate substrate (KALEDEX™ 2000) having a thickness of 3.5 mils to form a coating of the anticurl backside coating layer comprised of the dendritic polyester polyol, the polyisocyanate, and the organotin catalyst with a ratio of 70/29/1 that upon drying (140° C. for 10 minutes) had a thickness of 16 microns.

Example II

A photoconductor was prepared by repeating the process of Comparative Example 1 except that the ACBC layer solution was prepared by introducing into an amber glass bottle in a weight ratio of 35/35/29/1 P1000, a dendritic polyester polyol, OH value of 430 to 490 mg KOH/grams, $M_w$ (GPC)=1,500, commercially available from Perstorp Specialty Chemicals, Perstorp, Sweden; PARALOID™ AT-410, an acrylic polyol, 73 percent in methyl amyl ketone, $T_g$=30° C., OH equivalent weight=880, acid number=25, $M_w$=9,000, commercially available from Rohm and Haas, Philadelphia, Pa.; DESMODUR® BL 3175A, an aliphatic blocked polyisocyanate based on hexamethylene diisocyanate, blocked NCO content of 11.1 percent, solids of 75 percent±2 percent, viscosity of 3,000±1,000 mPa*s at 25° C., commercially available from Bayer of Germany; and dibutyltin dilaurate, an organotin catalyst. The resulting mixture was then applied on the back of a substrate of a biaxially oriented polyethylene naphthalate substrate (KALEDEX™ 2000) having a thickness of 3.5 mils to form a coating of the anticurl backside layer comprised of the dendritic polyester polyol, the acrylic polyol, the polyisocyanate, and the organotin catalyst with a ratio of 35/35/29/1 that upon drying (140° C. for 10 minutes) had a thickness of 15 microns.

Example III

A photoconductor was prepared by repeating the process of Comparative Example 1 except that a 2 micron second layer was coated on top of the existing ACBC layer situated on the backside of the photoconductor. The second layer solution was prepared by introducing into an amber glass bottle in a weight ratio of 70/29/1 P1000, a dendritic polyester polyol, OH value of 430 to 490 mg KOH/grams, $M_w$ (GPC)=1,500, commercially available from Perstorp Specialty Chemicals, Perstorp, Sweden; DESMODUR® BL 3175A, an aliphatic blocked polyisocyanate based on hexamethylene diisocyanate, blocked NCO content of 11.1 percent, solids of 75 percent±2 percent, viscosity of 3,000±1,000 mPa*s at 25° C., commercially available from Bayer of Germany; and dibutyltin dilaurate, an organotin catalyst. This solution was applied on the existing ACBC layer to form a coating of the anticurl backside coating second layer comprised of the dendritic polyester polyol, the polyisocyanate, and the organotin catalyst with a ratio of 70/29/1 that upon drying (140° C. for 10 minutes) had a thickness of 2 microns.

Example IV

A photoconductor was prepared by repeating the process of Comparative Example 1 except that a 2 micron second layer was coated on top of the existing ACBC layer situated on the backside of the photoconductor. The second layer solution was prepared by introducing into an amber glass bottle in a weight ratio of 35/35/29/1 P1000, a dendritic polyester polyol, OH value of 430 to 490 mg KOH/grams, $M_w$ (GPC)=1,500, commercially available from Perstorp Specialty Chemicals, Perstorp, Sweden; PARALOID™ AT-410, an acrylic polyol, 73 percent in methyl amyl ketone, $T_g$=30° C., OH equivalent weight=880, acid number=25, $M_w$=9,000, commercially available from Rohm and Haas, Philadelphia, Pa.; DESMODUR® BL 3175A, an aliphatic blocked polyisocyanate based on hexamethylene diisocyanate, blocked NCO content of 11.1 percent, solids of 75 percent±2 percent, viscosity of 3,000±1,000 mPa*s at 25° C., commercially available from Bayer of Germany; and dibutyltin dilaurate, an organotin catalyst. The resulting solution was applied on the existing ACBC layer to form a coating of the anticurl backside second layer comprised of the dendritic polyester polyol, the acrylic polyol, the polyisocyanate, and the organotin catalyst with a ratio of 35/35/29/1 that upon drying (140° C. for 10 minutes) had a thickness of 2 microns.

Surface Resistivity Measurements

The surface resistivity of the ACBC layer was measured for the photoconductors of Comparative Example 1 and the disclosed ACBC layers of Examples I, II, III and IV. The surface resistivity measurements were performed under 1,000 volts using a High Resistivity Meter (Hiresta-Up MCP-HT450 from Mitsubishi Chemical Corp.). Four to six measurements at varying spots (72° F./65 percent room humidity) were collected, with the surface resistivity results shown in Table 1.

TABLE 1

| | Surface Resistivity (ohm/sq) |
|---|---|
| Comparative Example 1 | $10^{16}$ |
| Example I, One-Layer Dendritic Polyester Polyol/Polyisocyanate ACBC Layer | $1.6 \times 10^{8}$ |
| Example II, One-Layer Dendritic Polyester Polyol/Acrylic Polyol/Polyisocyanate ACBC Layer | $2.8 \times 10^{10}$ |
| Example III, Two-Layer Dendritic Polyester Polyol/Polyisocyanate ACBC Top Layer | $1.6 \times 10^{8}$ |
| Example IV, Two-Layer Dendritic Polyester Polyol/Acrylic Polyol/Polyisocyanate ACBC Top Layer | $2.8 \times 10^{10}$ |

The disclosed Examples I (one-layer) and III (two-layer) ACBC layers were about 8 orders of magnitude less resistive than the Comparative Example 1 ACBC layer, which indicated that less charge would be accumulated on the Examples I and III ACBC layers with xerographic cycling.

Similarly, the disclosed Examples II (one-layer) and IV (two-layer) ACBC layers were about 6 orders of magnitude less resistive than the Comparative Example 1 ACBC layer, which indicated that less charge would be accumulated on the Examples II and IV ACBC layers with xerographic cycling as contrasted to the comparative Example 1 photoconductor.

It is believed that the above dendritic polyester, polyol/polyisocyanate, catalyst ACBC layer photoconductors will assist in the elimination of charge buildups at the back of the above photoconductors.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor consisting of a backing layer, a supporting substrate thereover, a photogenerating layer, and a charge transport layer consisting of at least one charge transport component, and wherein said backing layer is in contact with said supporting substrate on the reverse side thereof, and wherein the backing layer consists of a polyurethane of a dendritic polyester polyol and a polyisocyanate, an optional catalyst and an optional an acrylic polyol.

2. A photoconductor in accordance with claim 1 wherein said backing layer is an anticurl backside coating layer, and wherein the backing layer thickness is from about 1 to about 50 microns.

3. A photoconductor in accordance with claim 1 wherein said backing layer includes a first and a second layer, the first layer being adjacent to said substrate, said first layer being a polymer selected from a group consisting of polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof, and with a first layer thickness of from about 1 to about 50 microns; and wherein said second layer is situated on top of the first layer, and which second layer is said polyurethane this formed by the reaction of said dendritic polyester polyol and said polyisocyanate, and wherein said second layer thickness is from about 0.1 to about 30 microns.

4. A photoconductor in accordance with claim 3 wherein said first layer is a polycarbonate of a thickness of from about 5 to about 30 microns, and said second layer is of a thickness of from about 1 to about 10 microns.

5. A photoconductor in accordance with claim 3 wherein said dendritic polyester polyol is formed by the polymerization of a trialkylolalkyl core and 2,2-dimethylol propionic acid, and which polyol possesses a weight average molecular weight of from about 500 to about 50,000, and a hydroxyl value of from about 30 to about 1,000 milligrams KOH/gram.

6. A photoconductor in accordance with claim 5 wherein said core is trimethylolpropane, and said dendritic polyester polyol possesses a weight average molecular weight of from about 1,000 to about 10,000, and a hydroxyl value of from about 200 to about 700 milligrams KOH/gram.

7. A photoconductor in accordance with claim 3 wherein said polyisocyanate is a blocked aliphatic polyisocyanate or a blocked aromatic polyisocyanate.

8. A photoconductor in accordance with claim 1 wherein said dendntic polyester polyol is present in an amount of from about 10 to about 80 weight percent, and said polyisocyanate is present in an amount of from about 90 to about 20 weight percent.

9. A photoconductor in accordance with claim 8 wherein said dendritic polyester polyol is present in an amount of from about 30 to about 60 weight percent, and said polyisocyanate is present in an amount of from about 70 to about 40 weight percent of said polyurethane backing layer.

10. A photoconductor in accordance with claim 1 wherein said catalyst is present and is selected in an amount of between about 0.01 and about 5 weight percent, and which catalyst functions to cause crosslinking of said polyurethane, and where the crosslinking value is between about 50 and about 90 percent and wherein said polyurethane is generated by the reaction of said dendntic polyester polyol and said polyisocyanate.

11. A photoconductor in accordance with claim 10 wherein said catalyst is an organotin catalyst of dibutyltin dilaurate selected in an amount of from about 0.1 to about 1 weight percent.

12. A photoconductor in accordance with claim 1 wherein said catalyst is present and which catalyst is selected in an amount of between about 0.01 and about 5 weight percent, and which catalyst functions to cause crosslinking of said polyurethane, and where the crosslinking value is between about 50 and about 95 percent.

13. A photoconductor in accordance with claim 1 wherein said acrylic polyol is present and is selected in an amount of from about 1 to about 80 weight percent and wherein said polyurethane is generated by the reaction of said dendritic polyester polyol and said polyisocyanate.

14. A photoconductor in accordance with claim 13 wherein said acrylic polyol is generated by the polymerization of an acrylic, a styrene, a derivative of an acrylic, a styrene derivative of methacrylic acid, a styrene derivative of methacrylic acid, or mixtures thereof, each selected in an amount of from about 10 to about 60 weight percent.

15. A photoconductor in accordance with claim 14 wherein said derivatives of acrylic, and said derivatives of methacrylic acid are selected from the group consisting of n-alkyl acrylates, secondary and branched chain alkyl acrylates, olefinic acrylates, aminoalkyl acrylates, ether acrylates, cycloalkyl acrylates, halogenated alkyl acrylates, glycol acrylates and diacrylates, alkyl methacrylates; unsaturated alkyl methacrylates, cycloalkyl methacrylates, aryl methacrylates, hydroxyalkyl methacrylates, ether methacrylates, oxiranyl methacrylates, aminoalkyl methacrylates, glycol dimethacrylates, trimethacrylates, carbonyl-containing methacrylates, other nitrogen-containing methacrylates, halogenated alkyl methacrylates, sulfur-containing methacrylates, phosphorous-boron-silicon-containing methacrylates, N-methylmethacrylamide, N-isopropylmethacrylamide, N-phenylmethacrylamide, N-(2-hydroxyethyl)methacrylamide, 1-methacryloylamido-2-methyl-2-propanol, 4-methacryloylamido-4-methyl-2-pentanol, N-(methoxymethyl) methacrylamide, N-(dimethylaminoethyl)methacrylamide, N-(3-dimethylaminopropyl) methacrylamide, N-acetylmethacrylamide, N-methacryloylmaleamic acid, methacryloylamidoacetonitrile, N-(2-cyanoethyl)methacrylamide, 1-methacryloylurea, N-phenyl-N-phenylethylmethacrylamide, N-(3-dibutylaminopropyl)methacrylamide, N,N-diethylmethacrylamide, N-(2-cyanoethyl)-N-methylmethacrylamide, N,N-bis(2-dsethylaminoethyl)methacrylamide, N-methyl-N-phenylmethacrylamide, N,N'-methylenebismethacrylamide, N,N'-ethylenebismethacrylamide, and N-(diethylphosphono)methacrylamide, and mixtures thereof.

16. A photoconductor in accordance with claim 1 wherein said backing layer is located opposite the supporting substrate surface not in contact with the photogenerating layer, and wherein the polyisocyanate is a blocked polyisocyanate.

17. A photoconductor in accordance with claim 1 wherein said charge transport component is at least one of

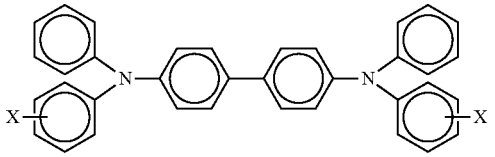

and

-continued

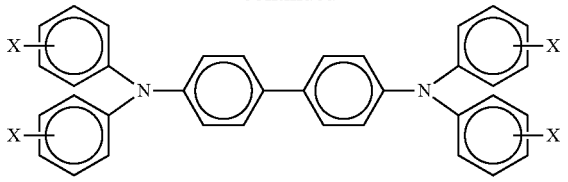

wherein X is selected from the group consisting of at least one of alkyl, alkoxy, aryl, and halogen and wherein said polyurethane is generated by the reaction of said dendritic polyester polyol and said oolvisocyanate.

18. A photoconductor in accordance with claim 17 wherein said alkyl and said alkoxy each contains from about 1 to about 12 carbon atoms, and said aryl contains from about 6 to about 36 carbon atoms, and wherein said charge transport layer is 1, 2, or 3 layers 4, and wherein the polyisocyanate is a blocked polyisocyanate.

19. A photoconductor in accordance with claim 17 wherein said component is an aryl amine of N,N'-diphenyl-N,N-bis(3-methylphenyl)-1,1'-biphenyl-4,4'-diamine.

20. A photoconductor in accordance with claim 1 wherein said charge transport component is

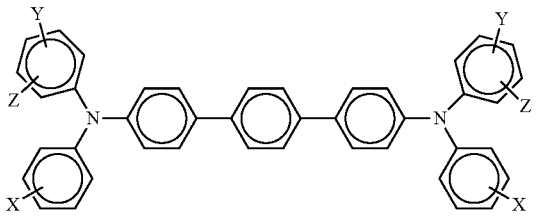

wherein X, Y and Z are independently selected from the group consisting of at least one of alkyl, alkoxy, aryl, and halogen.

21. A photoconductor in accordance with claim 20 wherein said alkyl and alkoxy each contains from about 1 to about 12 carbon atoms, and said aryl contains from about 6 to about 36 carbon atoms and wherein the polyisocyanate is a blocked polyisocyanate.

22. A photoconductor in accordance with claim 1 wherein said charge transport component is selected from the group consisting of N,N'-diphenyl-N,N-bis(3-methylphenyl)-1,1'-biphenyl-4,4'-diamine, N,N'-bis-(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine and mixtures thereof; said polyisocyanate is a blocked polyisocyanate, and optionally wherein said charge transport layer is 1, 2, or 3 layers.

23. A photoconductor in accordance with claim 1 wherein the polyisocyanate is a blocked polyisocyanate that is substantially inactive at a temperature of between about 45° C. and about 79° C., and where said polyisocyanate is active at a temperature of between about 80° C. and about 125° C. and wherein said polyurethane is generated by the reaction of said dendritic polyester polyol and said polyisocyanate.

24. A photoconductor in accordance with claim 1 wherein said photogenerating layer includes a photogenerating pigment or photogenerating pigments.

25. A photoconductor in accordance with claim 24 wherein said photogenerating pigment is at least one of a metal phthalocyanine, a metal free phthalocyanine, a perylene, and mixtures thereof.

26. A photoconductor in accordance with claim 1 wherein said substrate is a conductive material, and wherein said backing layer is in contact with said substrate and wherein the polyisocyanate is a blocked polyisocyanate that is substantially inactive at temperatures of from about 25° C. to about 80° C., said catalyst is present, wherein the polyurethane possesses a crosslinking value of from about 50 to about 90 percent and wherein said polyurethane is generated by the reaction of said dendritic polyester polyol and said polyisocyanate.

27. A photoconductor in accordance with claim 1 wherein said charge transport layer is from 1 to about 3 layers, and wherein said charge transport component is represented by at least one of the following formulas/structures and wherein said polyurethane is generated by the reaction of said dendritic polyester polyol and said polyisocyanate.

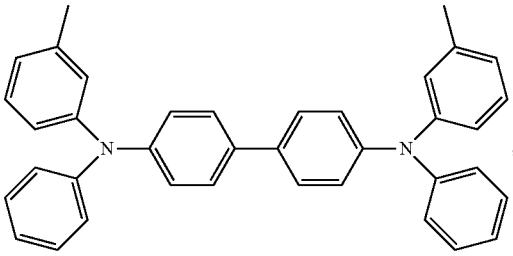

;

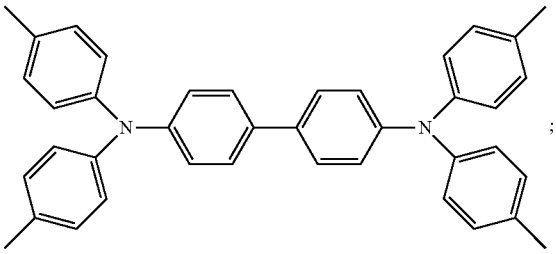

;

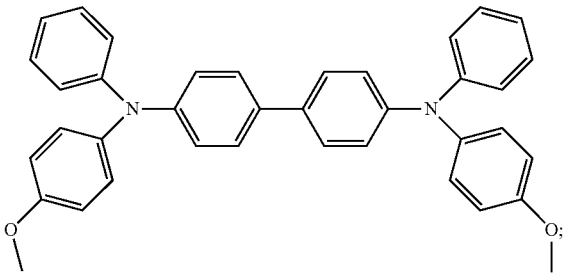

;

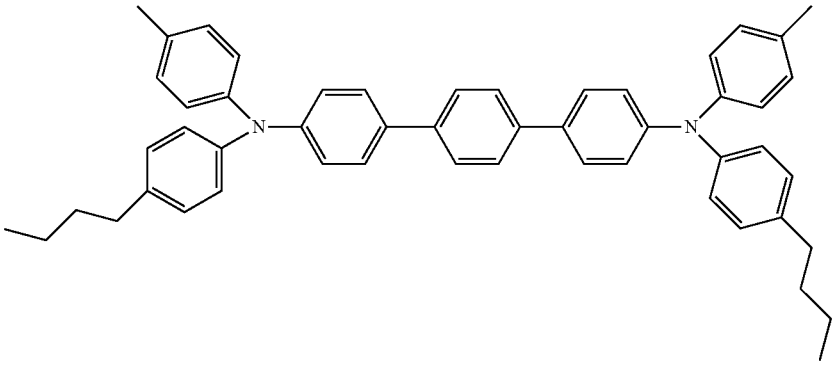

;

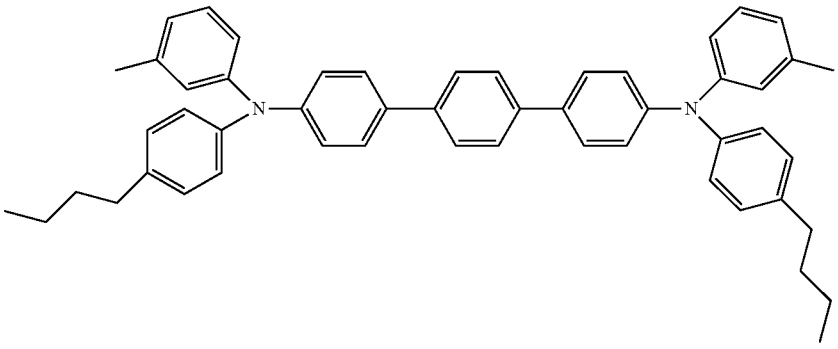

; and

-continued

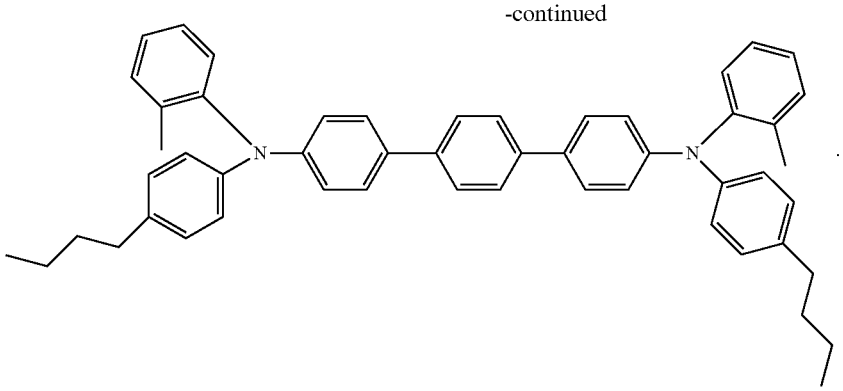

28. A photoconductor in accordance with claim 1 wherein said charge transport layer includes a top charge transport layer and a bottom charge transport layer, and wherein said top layer is in contact with said bottom layer, and said bottom layer is in contact with said photogenerating layer, and wherein the polyisocyanate is a blocked polyisocyanate that is substantially inactive at temperatures of between about 50° C. and about 79° C., wherein said catalyst is present and wherein the polyurethane possesses a crosslinking value of between about 70 and 90 percent.

29. A photoconductor in accordance with claim 1 said backing layer is an anticurl layer and wherein said polyester polyol is formed by the polymerization of trimethylolpropane and 2,2-dimethyol propionic acid, said polyisocyanate is a blocked aliphatic polyisocyanate, and wherein said polyurethane is conductive and possesses a crosslinking density of from about 50 to about 90 percent.

30. A photoconductor in accordance with claim 29 wherein said anticurl layer has a thickness of between about 10 and about 50 microns, wherein said anticurl layer is located opposite the supporting substrate surface not in contact with the photogenerating layer, said polyisocyanate is a blocked polyisocyanate that is substantially inactive at temperatures between about 50° C. and about 79° C., and wherein the polyurethane possesses a crosslinking value of between about 70 and 90 percent.

* * * * *